US005165783A

United States Patent [19]

Barron, Sr.

[11] Patent Number: 5,165,783

[45] Date of Patent: Nov. 24, 1992

[54] PICTURE FRAME MOUNTED ILLUMINATING DEVICE

[76] Inventor: Lee H. Barron, Sr., 4515 Alta Canyada Rd., LaCanada, Calif. 91011

[21] Appl. No.: 815,280

[22] Filed: Dec. 27, 1991

[51] Int. Cl.[5] ..... A47G 1/06

[52] U.S. Cl. ..... 362/253; 362/418; 362/432; 40/152.2

[58] Field of Search ..... 362/98, 125, 418, 432, 362/806, 253; 40/152.2

[56] References Cited

U.S. PATENT DOCUMENTS

| | | | |
|---|---|---|---|
| 947,127 | 1/1910 | Roberts . | |
| 1,409,114 | 3/1922 | Loveberg | 40/152.2 |
| 1,739,320 | 12/1929 | Lloyd | 40/152.2 |
| 2,233,280 | 2/1941 | Barnes | 40/152.2 |
| 2,677,909 | 5/1954 | Heydenryk | 40/152.2 |
| 3,289,342 | 12/1966 | Gibson, Jr. | 40/152.2 |
| 3,406,475 | 10/1968 | O'Donnell | 40/130 |
| 3,475,603 | 10/1969 | Gheno | 240/2 |
| 3,742,203 | 6/1973 | Noe | 240/4 |
| 4,282,669 | 8/1981 | Rieumont | 40/453 |
| 4,386,476 | 6/1983 | Schulman | 40/546 |
| 4,507,884 | 4/1985 | Kazanjian | 40/152.2 |

*Primary Examiner*—Richard R. Cole

*Attorney, Agent, or Firm*—Hill, Van Santen, Steadman & Simpson

[57] ABSTRACT

A framed picture illuminating device comprises a light fixture having a bracket for attachment to the picture frame and a shelf portion to project forwardly from the frame, an elongated housing structure has a base wall resting on the shelf portion, an elongated concave reflector supported by the housing is reflective toward the picture, a fluorescent light tube is supported operatively in the reflector. The housing is adjustable on the shelf portion in keeping with the cross sectional width of the frame bar to which attached and for attaining desired illumination results with respect to the subject matter of the picture.

22 Claims, 1 Drawing Sheet

PICTURE FRAME MOUNTED ILLUMINATING DEVICE

BACKGROUND OF THE INVENTION

The present invention relates to an illuminating device for mounting on a picture frame for providing superior lighting for the picture in the frame.

Heretofore, numerous and varied framed picture illuminating devices have been proposed, including the use of fluorescent light tubes for attaining a softer, more uniform lighting of picture than can be obtained by the use of the conventional elongated incandescent lamps that have been in use for a great many years for individual framed picture illumination. The problem with the incandescent lamps is that the illumination is focused on a very limited area which is brightly illuminated and the light rapidly drops off to relative obscurity.

In the proposals for picture frame mounted fluorescent tubes, the results have been largely unsatisfactory. Major drawbacks have been complexity of design with regard to structural features, mounting difficulties and cost.

SUMMARY OF THE PRESENT INVENTION

An important object of the present invention is to provide a new and improved framed picture illuminating device for fluorescent lighting.

Another object of the invention is to provide a framed picture lighting device which is structurally simple, easy and convenient to mount on a picture frame for illuminating the picture to best advantage.

Still another object of the invention is to provide a framed picture illuminating device which is adapted to be manufactured and supplied at low cost.

Pursuant to the principles of the present invention, there is provided in combination with a frame of a framed picture, a light fixture, comprising a bracket attached to the picture frame and having a shelf portion projecting forwardly from the frame, an elongated housing having a base wall resting on the shelf portion, an elongated concave reflector supported by the housing and reflective toward the picture, a fluorescent light tube, and means for replaceably mounting the fluorescent light tube operatively in the reflector.

DETAILED DESCRIPTION

Figure 1:
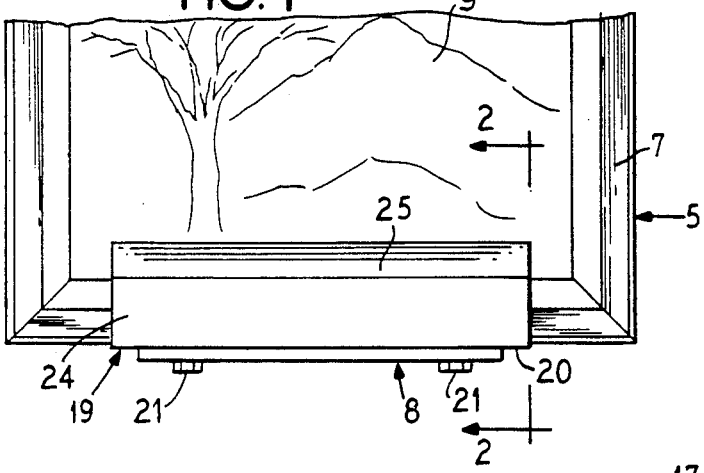
FIG. 1 is a fragmentary front elevational view of a framed picture having an illuminating device embodying the present invention mounted thereon.

As seen in FIG. 1, a framed picture 5 has mounted on its frame 7 an illuminating device 8 for advantageously lighting a picture 9 carried by the frame 7. While the frame 7 may have any preferred ornamental profile, it has as is customary a rear surface 10 and a lateral surface 11, which may be along the bottom bar, either side bar or top bar of the frame.

The illuminating device 8 comprises a generally L-shaped cross section mounting bracket 12 having a gauging flange 13 which engages with the rear surface 10 of the frame 7. Projecting forwardly in engagement with the lateral frame surface 11 is a bracket platform flange 14 which is of a width to provide a shelf portion 14*a* extending substantially forwardly from the front face of the frame 7. Where feasible, the bracket 12 may be secured to the frame 7 as by means of wood screws 15 extending through screw holes 17 in the flange 13. Where that is not feasible, the screws 15 may be applied through holes 18 in the platform flange 14 for securing the bracket to the selected frame surface 11. Although the device 8 is depicted in FIG. 1 as attached to the lower bar of the frame 7, it is possible to attach the device to either of the side bars of the frame or a customary top frame bar (not shown) so as to have illumination from the fixture 8 directed toward the picture 9 to best advantage for displaying the picture subject matter.

Mounted on the shelf portion 14*a* of the platform flange 14 is a fluorescent tube carrying housing structure 19, which has a base wall 20 resting on the shelf portion 14*a* and adjustably secured thereto by means of bolts 21. These bolts 21 desirably extend through parallel front to rear slots 22 in the flange 14 and matching front to rear slots 23 in the base wall 20. Through this arrangement the housing 19 can be adjusted toward and away from the framed picture 5 in keeping with the cross sectional width of the bar of the frame 7 to which attached and to attain maximum illumination results.

Upstanding from the base wall 20 of the housing 19 is a wall 24 to the distal end portion of which is secured a reflector 25 of generally half-moon concave cross section for reflecting light from a fluorescent tube 27 efficiently toward the picture 9.

Figure 2:
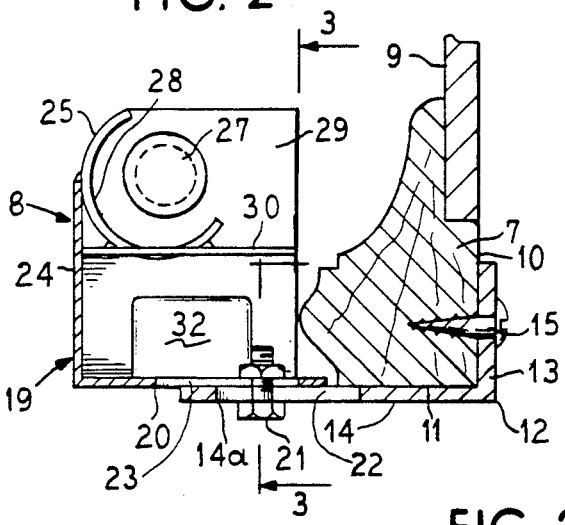
FIG. 2 is an enlarged fragmentary sectional detail view taken substantially along the line 2—2 of FIG. 1.
Figure 4:
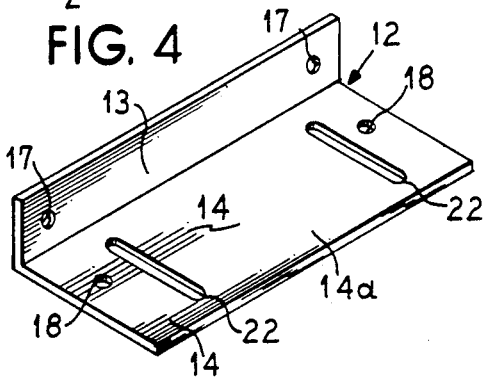
FIG. 4 is an isometric illustration of a mounting bracket for the device.
Figure 3:
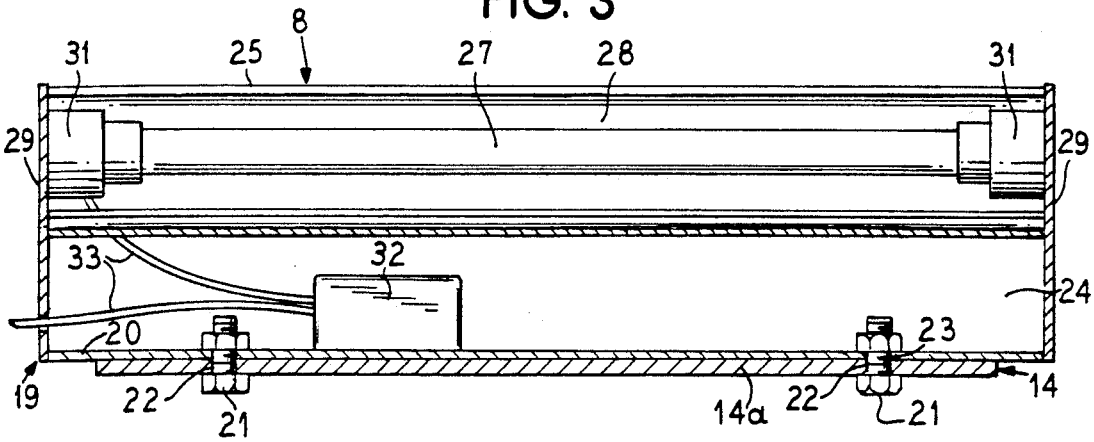
FIG. 3 is a sectional detail view taken substantially along the line 3—3 of FIG. 2.

In a preferred construction, the reflector 25 which has a polished reflecting surface 28 is constructed from metal welded or braised to the wall 24 along its length, and similarly secured to end walls 29 carried by the housing 19 fixedly on the base wall 20 and attached to the upstanding wall 24. A reflector supporting and stabilizing web 30 may be fixedly secured to the walls 24 and 29 and the reflector 25 substantially as shown in FIG. 2.

At its opposite ends, the fluorescent tube 27 is replaceably mounted in customary manner by means of end brackets 31 mounted on the end walls 29. A transformer/ballast means 32 is conveniently mounted on the base wall 20 under the stabilizing web 30, and has electrical wiring 33 leading to contact means for the tube 27 and an electrical source in a conventional manner.

All parts of the device 8 that lend themselves to being made from aluminum sheet material are preferably constructed of that material for lightweight and ease of manufacture. The device 8 may be of any preferred length having in mind the standard lengths of fluorescent tubes available on the market.

The device 8 may be supplied to the user ready to be mounted, which can be effected by driving of the two screws 15. To attain the advantageous illumination of the picture 9 the housing 19 is adjusted toward or away from the picture with the fluorescent tube in its lighting mode, until the desired advantageous result is observed, whereupon the bolts 21 are tightened to retain that orientation.

It will be apparent that various modifications and/or additions may be made in the apparatus of the invention without departing from the essential feature of novelty involved, which are intended to be defined and secured by the appended claims.

I claim as my invention:

1. For mounting on a frame for a picture, a light fixture, comprising:

a bracket for attachment to the picture frame and having a shelf portion for projecting forwardly from the frame;

an elongated housing structure having a base wall resting on said shelf portion in face-to-face relation;

an elongated concave reflector supported by said housing structure and adapted to reflect toward the picture of the frame to which the device is attached;

a fluorescent light tube; and means for replaceably mounting the fluorescent light tube operatively in said reflector.

2. A fight fixture according to claim 1, wherein said bracket is of L-shaped cross-section with a gaging flange for attachment to a rear surface of the picture frame.

3. A light fixture according to claim 2, wherein said shelf portion is part of a platform flange extending from said gaging flange.

4. A fixture according to claim 3, wherein both said gaging flange and said platform flange have screw holes.

5. A fixture according to claim 1, wherein said base wall and shelf portion have means enabling said light fixture to be adjusted toward or away from the picture.

6. A fixture according to claim 5, wherein said means for adjusting comprise matching front to rear elongated slots in said shelf portion and said base wall, and tightening bolts operatively engaged in said slots.

7. A fixture according to claim 1, including a supporting and reinforcing web attached to said reflector.

8. A fixture according to claim 7, wherein said housing has a front wall and end walls, and said web is attached to said front and end walls.

9. A fixture according to claim 1, wherein said housing has a front wall and end wall, said reflector being attached to said front wall and said end walls, and said mounting means for said light tube comprising brackets carried by said end walls.

10. A fixture according to claim 9, wherein said housing includes a reflector supporting and stabilizing web spaced above said bottom wall, and a transformer/ballast means located in the space between said web and said bottom wall and having electrical connections with said tube and with an electrical energy source.

11. In combination with a frame of a framed picture, a light fixture, comprising:

a bracket attached to the picture frame and having a shelf portion projecting forwardly from the frame;

an elongated housing structure having a base wall resting in face-to-face relation on said shelf portion and forming a side of said housing;

an elongated concave reflector supported by said housing structure and reflective toward said picture;

a fluorescent light tube; and means for replaceably mounting said fluorescent light tube operatively in said reflector.

12. A combination according to claim 11, wherein said bracket is of L-shaped cross-section with a gaging flange attached to a rear surface of said picture frame.

13. A combination according to claim 12, wherein said shelf portion is part of a platform flange extending from said gaging flange.

14. A combination according to claim 13, wherein both said gaging flange and said platform flange have screw holes.

15. A combination according to claim 11, wherein said base wall and shelf portion have means enabling said light fixture to be adjusted toward or away from the picture.

16. A combination according to claim 15, wherein said means for adjusting comprise matching front to rear elongated slots in said shelf portion and said base wall, and tightening bolts operatively engaged in said slots.

17. A combination according to claim 11, including a supporting and reinforcing web attached to said reflector.

18. A combination according to claim 17, wherein said housing has a front wall and end walls, and said web is attached to said front and end walls.

19. A combination according to claim 11, wherein said housing has a front wall and end walls, said reflector being attached to said front wall and said end walls, and said mounting means for said light tube comprising brackets carried by said end walls.

20. A combination according to claim 19 wherein said housing includes a reflector supporting and stabilizing web spaced above said bottom wall, and a transformer/ballast means located in the space between said web and said bottom wall and having electrical connections with said tube and with an electrical energy source.

21. For mounting on a frame for a picture, a light fixture comprising:

a bracket attached to the picture frame and having a shelf portion for projecting forwardly from the frame;

an elongated housing structure having a base wall resting on said shelf portion;

an elongated concave reflector supported by said housing structure and adapted to reflect toward the picture of the frame to which the device is attached;

a fluorescent light tube;

means for replaceably mounting said fluorescent light tube operatively in said reflector;

a supporting and reinforcing web attached to said reflector;

a front wall and end walls on said housing; and said web being attached to said front and end walls.

22. For mounting on a frame for a picture, a light fixture comprising:

a bracket attached to the picture frame and having a shelf portion for projecting forwardly from the frame;

an elongated housing structure having a base wall resting on said shelf portion;

an elongated concave reflector supported by said housing structure and adapted to reflect toward the picture of the frame to which the device is attached;

a fluorescent light tube;

means for replaceably mounting said fluorescent light tube operatively in said reflector;

a front wall and end walls on said housing;

said reflector being attached to said front wall and said end walls;

said mounting means for said light tube comprising brackets carried by said end walls;

said housing including a reflector supporting and stabilizing web spaced above said bottom wall; and a transformer/ballast means located in the space between said web and said bottom wall and having electrical connections with said tube and with an electrical energy source.

* * * * *